US010194774B2

(12) United States Patent
Buell et al.

(10) Patent No.: US 10,194,774 B2
(45) Date of Patent: Feb. 5, 2019

(54) INGESTION RESISTANCE THROUGH DELAYED DISPENSER ACTIVATION

(71) Applicant: GOJO Industries, Inc., Akron, OH (US)

(72) Inventors: Shelby Jay Buell, Medina, OH (US); Richard E. Corney, Akron, OH (US)

(73) Assignee: GOJO Industries, Inc., Akron, OH (US)

( * ) Notice: Subject to any disclaimer, the term of this patent is extended or adjusted under 35 U.S.C. 154(b) by 213 days.

(21) Appl. No.: 14/743,202

(22) Filed: Jun. 18, 2015

(65) Prior Publication Data

US 2015/0366412 A1 Dec. 24, 2015

Related U.S. Application Data

(60) Provisional application No. 62/014,238, filed on Jun. 19, 2014.

(51) Int. Cl.
*A47K 5/12* (2006.01)

(52) U.S. Cl.
CPC ..... *A47K 5/1217* (2013.01); *A47K 5/12* (2013.01); *A47K 5/1202* (2013.01)

(58) Field of Classification Search
CPC ..... A47K 5/10; A47K 5/12; A47K 5/1202; A47K 5/1217
See application file for complete search history.

(56) References Cited

U.S. PATENT DOCUMENTS 3,459,343 A * 8/1969 Rasmussen ..... A47K 5/10 222/156
3,731,856 A * 5/1973 Young ..... G01F 11/32 222/477
3,847,304 A * 11/1974 Cohen ..... B67D 7/0216 222/105
4,345,627 A * 8/1982 Cassia ..... A47K 5/1208 141/18
8,281,958 B2 * 10/2012 Matthews ..... A47K 5/14 222/1

(Continued)

OTHER PUBLICATIONS

Int. Search Report/Written Opinion cited in PCT Application No. PCT/US2015/036408 dated Nov. 11, 2015, 19 pgs.

*Primary Examiner* — Frederick C Nicolas
*Assistant Examiner* — Bob Zadeh
(74) *Attorney, Agent, or Firm* — Cooper Legal Group, LLC

(57) ABSTRACT

A dispensing system includes a container within which a material is contained and an actuation device movably supported with respect to the container. The actuation device is movable between a first position and a second position. The dispensing system includes a control system. The control system includes an engagement portion in movable engagement with the actuation device. The control system includes a control portion. As the actuation device is moved from the first position to the second position a first time, the control portion does not restrain movement of either the engagement portion or the actuation device. As the actuation device is moved between the first position and the second position a second time within a predetermined time period after the first time, the control portion restrains movement of at least one of the engagement portion or the actuation device.

20 Claims, 10 Drawing Sheets

(56) References Cited

U.S. PATENT DOCUMENTS

| | | | | |
|---|---|---|---|---|
| 8,459,509 | B2 * | 6/2013 | Bui | B01L 3/0265 222/181.1 |
| 8,672,187 | B2 * | 3/2014 | Ophardt | A47K 5/1207 222/145.5 |
| 2005/0263545 | A1 * | 12/2005 | Ophardt | G01F 11/025 222/477 |
| 2009/0212150 | A1 | 8/2009 | Wruck, Jr. et al. | |
| 2013/0299518 | A1 * | 11/2013 | McNulty | A47K 5/14 222/190 |
| 2015/0366412 | A1 * | 12/2015 | Buell | A47K 5/1217 222/52 |

* cited by examiner

INGESTION RESISTANCE THROUGH DELAYED DISPENSER ACTIVATION

CROSS-REFERENCE TO RELATED APPLICATIONS

This application claims priority to U.S. Provisional Patent Application No. 62/014,238, filed on Jun. 19, 2014, the entire disclosure of which is hereby incorporated by reference.

TECHNICAL FIELD

The instant application is generally directed towards a dispensing system. For example, the instant application is directed towards a control system for a dispensing system.

BACKGROUND

Dispensing systems can dispense a sanitizing material to a user. Dispensing systems can be used, for example, in schools, hospitals, nursing homes, factories, restaurants, etc.

SUMMARY

This summary is provided to introduce a selection of concepts in a simplified form that are further described below in the detailed description. This summary is not intended to identify key factors or essential features of the claimed subject matter, nor is it intended to be used to limit the scope of the claimed subject matter.

In an example, a dispensing system comprises a container within which a material is contained and from which the material is dispensed. The dispensing system comprises an actuation device movably supported with respect to the container. The actuation device is movable between a first position, in which the material is not dispensed from the container, and a second position, in which at least some of the material is dispensed from the container. The dispensing system includes a control system movably supported with respect to the actuation device. The control system comprises an engagement portion in movable engagement with the actuation device. The control system comprises a control portion operably coupled to at least one of the engagement portion or the actuation device, wherein as the actuation device is moved from the first position to the second position a first time, the control portion is not configured to restrain movement of either the engagement portion or the actuation device. As the actuation device is moved between the first position and the second position a second time within a predetermined time period after the first time, the control portion is configured to restrain movement of at least one of the engagement portion or the actuation device.

In another example, a dispensing system comprises a container within which a material is contained and from which the material is dispensed. The dispensing system comprises an actuation device movably supported with respect to the container. The actuation device is movable between a first position, in which the material is not dispensed from the container, and a second position, in which at least some of the material is dispensed from the container. The dispensing system comprises a control system movably supported with respect to the actuation device. The control system comprises an engagement portion in movable engagement with the actuation device, the engagement portion movable as the actuation device moves between the first position and the second position. The control system comprises a control portion operably coupled to at least one of the engagement portion or the actuation device, wherein as the actuation device is moved from the first position to the second position a first time, the control portion is not configured to restrain movement of either the engagement portion or the actuation device. As the actuation device is moved from the first position to the second position a second time within a predetermined time period after the first time, the control portion is configured to restrain movement of at least one of the engagement portion or the actuation device.

In another example, a dispensing system comprises a container within which a material is contained and from which the material is dispensed. The dispensing system comprises a sensor coupled to the container and configured to detect a presence of a user in proximity to the dispensing system. The dispensing system comprises a control system coupled to the sensor. As the sensor detects the presence of the user in proximity to the dispensing system a first time, the control system is not configured to inhibit a dispense event such that at least some of the material is dispensed from the container. As the sensor detects the presence of the user in proximity to the dispensing system a second time within a predetermined time period after the first time, the control system is configured to inhibit a subsequent dispense event such that additional material is not dispensed from the container.

The following description and annexed drawings set forth certain illustrative aspects and implementations. These are indicative of but a few of the various ways in which one or more aspects can be employed. Other aspects, advantages, and/or novel features of the disclosure will become apparent from the following detailed description when considered in conjunction with the annexed drawings.

DETAILED DESCRIPTION

Figure 1:
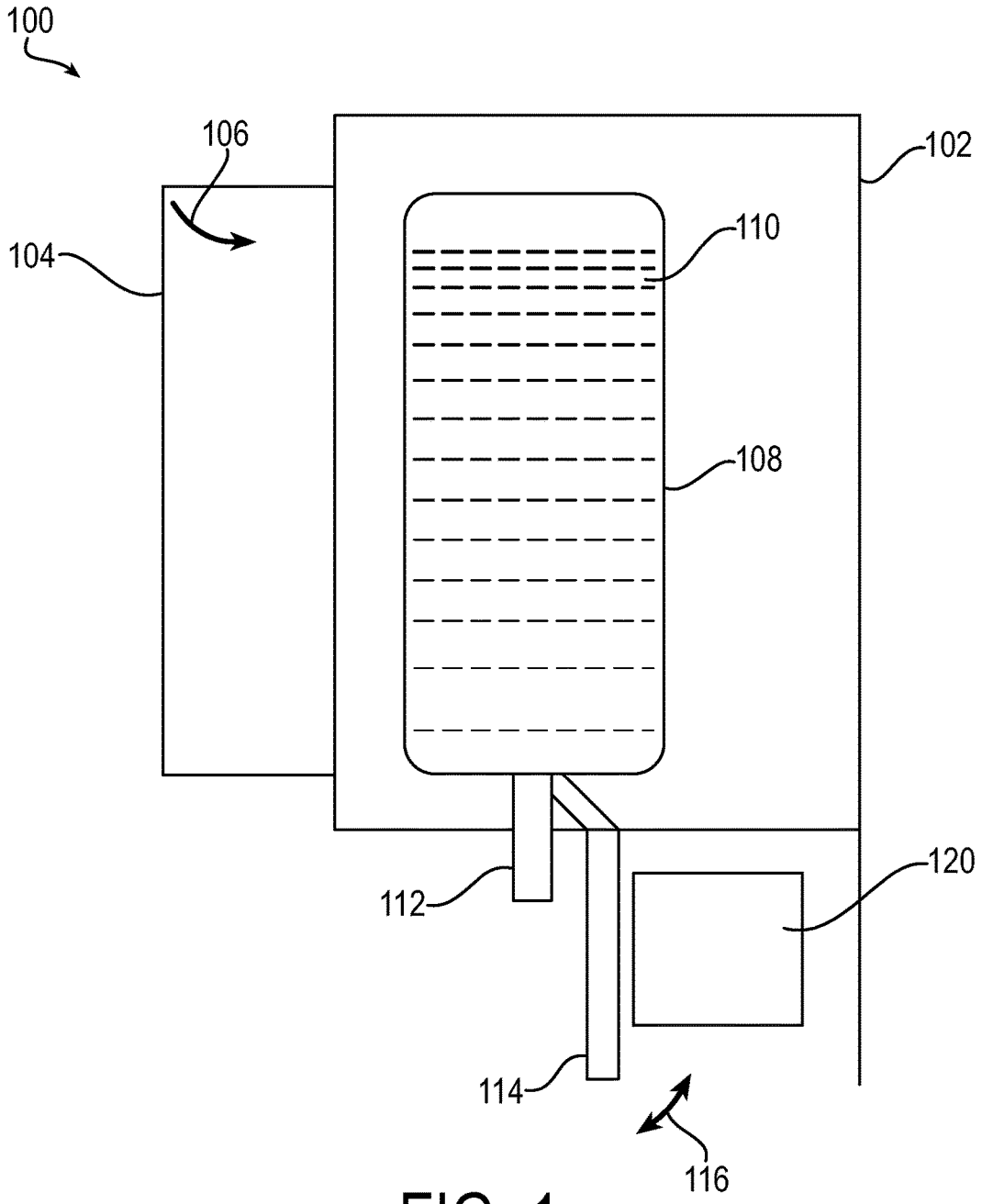
FIG. 1 is an illustration of at least some of an example dispensing system.

The claimed subject matter is now described with reference to the drawings, wherein like reference numerals are generally used to refer to like elements throughout. In the following description, for purposes of explanation, numerous specific details are set forth in order to provide an understanding of the claimed subject matter. It is evident, however, that the claimed subject matter can be practiced without these specific details. In other instances, structures and devices are illustrated in block diagram form in order to facilitate describing the claimed subject matter. Relative size, orientation, etc. of parts, components, etc. may differ from that which is illustrated while not falling outside of the scope of the claimed subject matter.

Turning to FIG. 1, a dispensing system 100 is illustrated. In general, the dispensing system 100 can be used for storing and/or dispensing a material. The dispensing system 100 can be attached, for example, to a surface, such as a surface of a wall, ceiling, door, object, support structure, etc. The dispensing system 100 can be used in any number of environments, including prisons/jails, detention centers, mental health facilities, hospitals, mental hospitals, rehabilitation facilities, nursing homes, restaurants, schools, factories, warehouses, etc.

The dispensing system 100 can include a housing 102. The housing 102 comprises an outer container/enclosure within which portions of the dispensing system 100 may be housed. In some examples, the housing 102 is generally hollow so as to receive structures therein. In the illustrated example, the housing 102 can include a rigid/durable structure/material that is resistant to tampering and/or inadvertent access. In an example, the housing 102 comprises a metal material, such as steel, aluminum, titanium, or the like. In other examples, the housing 102 comprises plastic materials, composite materials, etc. Indeed, the housing 102 comprises any number of materials that can limit inadvertent/unauthorized access to the interior of the housing 102.

The housing 102 may include a door 104 that is movable 106 (illustrated generically/schematically with arrowhead), such that the door 104 can be selectively opened and closed. In an opened position, as illustrated, access to the interior of the housing 102 may be provided. In a closed position, access to the interior of the housing 102 is generally limited. In some examples, the door 104 can be provided with a locking structure, such that a key (or other similar unlocking structure) may be used to open/close the door 104. The door 104 can be located at nearly any location within the housing 102, such as along a top surface, side surface, bottom surface, etc.

The dispensing system 100 includes a container 108 within which a material 110 is contained and from which the material 110 is dispensed. The container 108 includes one or more sidewalls that define an interior in which the material 110 is stored. In an example, the container 108 includes an outlet 112 (e.g., tube, nozzle, etc.) through which the material 110 can be selectively dispensed.

The material 110 includes any type of liquid, semi-liquid, gel, powder, foam based materials, etc. The material 110 can include, for example, cleaning materials such as disinfectants, sanitizers, antiseptics, soaps, moisturizers, alcohol-infused liquids or the like. In other examples, the material 110 may include water or other non-cleaning liquid materials. Indeed, the material 110 is not specifically limited to these examples, and could include any type of materials.

The dispensing system 100 may include an actuation device 114. The actuation device 114 is movably supported with respect to the container 108. In an example, the actuation device 114 can be movably attached (movability 116 illustrated with arrowheads) to the housing 102, such that the actuation device 114 is movable while the container 108 remains relatively stationary. In some examples, the actuation device 114 is operatively attached to the outlet 112, such that the actuation device 114 can selectively allow for the dispensing of the material 110 through the outlet 112. For example, the actuation device 114 may include and/or be associated with one or more valves, flow/fluid restriction devices, fittings, or the like that are associated and/or coupled to the outlet 112. As such, the actuation device 114 can be moved so as to allow for the dispensing of the material 110 from the container 108 and through the outlet 112. The actuation device 114 includes any number of structures, such as push bars, pull bars, handles, levers, etc.

The dispensing system 100 may include a control system 120. The control system 120 can be movably supported with respect to the actuation device 114. In some examples, the control system 120 can be supported by the housing 102. For example, the control system 120 can be supported within an interior of the housing 102 or at an exterior of the housing 102. In general, the control system 120 is in operative association with and/or coupled to the actuation device 114, such that movement of the actuation device 114 may cause movement of at least a portion of the control system 120. It is to be appreciated that the control system 120 comprises any number of structures, constructions, configurations, etc. As such, the control system 120 is illustrated generically/schematically in FIG. 1, as details of the control system 120 are further explained in the following description.

Figure 2A:
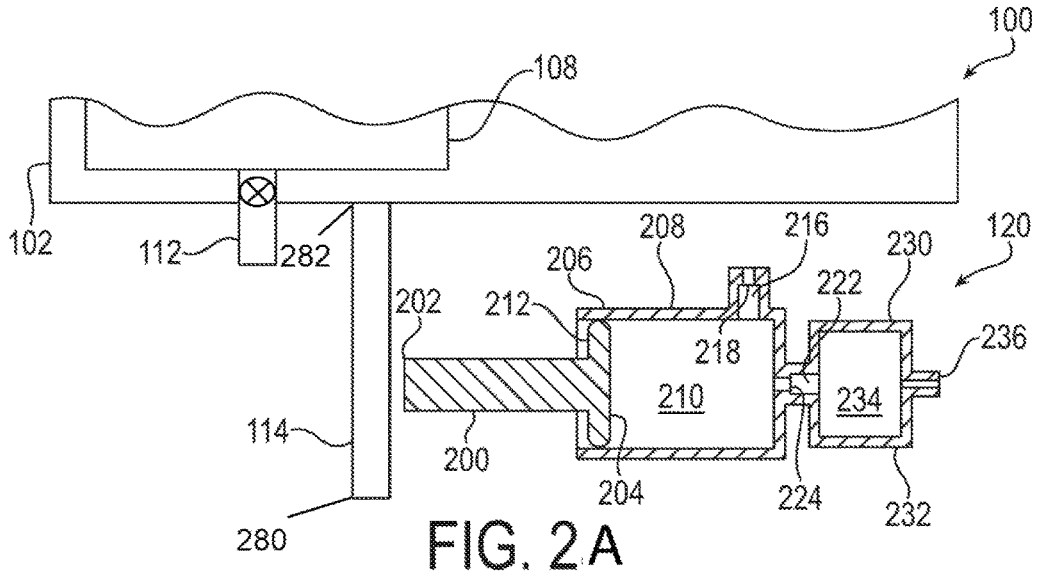
FIG. 2A is an illustration of at least some of an example dispensing system.

Turning to FIG. 2A, an example of a portion (e.g., lower portion) of the dispensing system 100 is illustrated. In this example, the dispensing system 100 comprises the control system 120 that is movably supported with respect to the actuation device 114. In an example, the control system 120 comprises an engagement portion 200. The engagement portion 200 is in movable engagement with the actuation device 114. For example, the engagement portion 200 includes a first end 202 and a second end 204. The first end 202 of the engagement portion 200 can contact/abut the actuation device 114, such that movement of the actuation device 114 can cause corresponding movement of the engagement portion 200. The first end 202 can, in some examples, be attached and/or fixed to the actuation device 114, such as with mechanical fasteners (e.g., screws, nuts, bolts, nails, etc.), adhesives, locking structures, or the like.

The engagement portion 200 can include a first housing 206. In an example, the first housing 206 includes one or more sidewalls 208, such that a first chamber 210 is defined by the sidewalls 208. While the first chamber 210, as defined by the sidewalls 208, comprises any number of sizes/shapes, in the illustrated examples, the first chamber 210 may have a generally rounded cross-sectional shape, such that the first chamber 210 defines a cylindrical shape. In other examples, however, the first chamber 210 may have a quadrilateral cross-sectional shape (e.g., square, rectangular, etc.), ovoid cross-sectional shape, etc.

The second end 204 of the engagement portion 200 is positioned within the first chamber 210. In this way, the second end 204 of the engagement portion 200 may be coupled to the control portion 230. In an example, the engagement portion 200 may have a non-constant cross-sectional size between the first end 202 and the second end 204.In some examples, the second end 204 of the engagement portion 200 comprises a sealing device 212 that is movable within the first chamber 210. In this example, the sealing device 212 can form a seal with the sidewalls 208 of the first housing 206, such as by contacting/engaging an inner surface of the sidewalls 208. As such, air and/or gas within the first chamber 210 is generally limited from leaking out of the first chamber 210 through/past the sealing device 212. To assist in this sealing function, the sealing device 212 may include a rubber or similar elastomeric material that is suitable for providing/forming a seal.

The sidewalls 208 of the first housing 206 may define a first opening 216. In an example, the first opening 216 defines a channel, passageway, conduit, etc. through which air/gas can enter the first chamber 210. The first opening 216 may be in fluid communication with the first chamber 210 at one end and with an exterior of the first housing 206 at a second end. In some examples, a first valve 218 may be positioned within the first opening 216. The first valve 218 comprises any number of different valves, including, but not limited to, check valves (e.g., one way valves) or the like. In some examples, the first valve 218 is movable between an opened position, in which air flows through the first opening 216 and into the first chamber 210, and a closed position, in which air does not flow through the first opening 216.

The sidewalls 208 of the first housing 206 may define a second opening 222. In an example, the second opening 222 defines a channel, passageway, conduit, etc. through which air/gas can exit the first chamber 210. The second opening 222 may be in fluid communication with the first chamber 210 at one end and with a control portion 230 at a second end. In some examples, a second valve 224 may be positioned within the second opening 222. The second valve 224 comprises any number of different valves, including, but not limited to, check valves (e.g., one way valves) or the like. In some examples, the second valve 224 is movable between an opened position, in which air flows through the second opening 222 and out of the first chamber 210, and a closed position, in which air does not flow through the second opening 222.

The control system 120 comprises a control portion 230 that is operably coupled to at least one of the engagement portion 200 or the actuation device 114. In this example, the control portion 230 is attached to the first housing 206 such that the control portion 230 is in fluid communication with the first chamber 210.

The control portion 230 includes one or more control portion sidewalls 232, such that a second chamber 234 is defined by the control portion sidewalls 232. The second chamber 234, as defined by the control portion sidewalls 232, comprises any number of sizes/shapes, such as a rounded and/or circular cross-sectional shapes, quadrilateral (e.g., square, rectangular, etc.) cross-sectional shapes, etc. In an example, the second chamber 234 has a smaller volume than the first chamber 210.

The control portion 230 is in fluid communication with the second opening 222 of the first housing 206. In an example, the second chamber 234 of the control portion 230 can receive air from the first chamber 210 through the second opening 222. According to some examples, when the second valve 224 is moved to the opened position, air flows out of the first chamber 210, through the second opening 222, and into the second chamber 234. When the second valve 224 is moved to the closed position, air does not flow through the second opening 222, such that air generally does not pass between the first chamber 210 and the second chamber 234.

The control portion sidewalls 232 define a third opening 236 through which air flows out of the second chamber 234. In an example, the third opening 236 defines a channel, passageway, conduit, etc. through which air/gas can exit the second chamber 234. The third opening 236 may be in fluid communication with the second chamber 234 at one end and with an exterior of the control portion 230 at a second end. In some examples, the third opening 236 defines a smaller cross-sectional size than a cross-sectional size of the first opening 216 and/or the second opening 222. As such, the third opening 236 may function as a slow-release valve, with air exiting the second chamber 234 through the third opening 236 at a slower rate than air enters the second chamber 234 through the second opening 222. The control portion 230 is not limited to including the third opening 236. Rather, in other examples, the control portion 230 may include a valve, such as a check valve (e.g., one way valves) or the like through which air may be slowly released from the control portion 230.

Figure 2B:
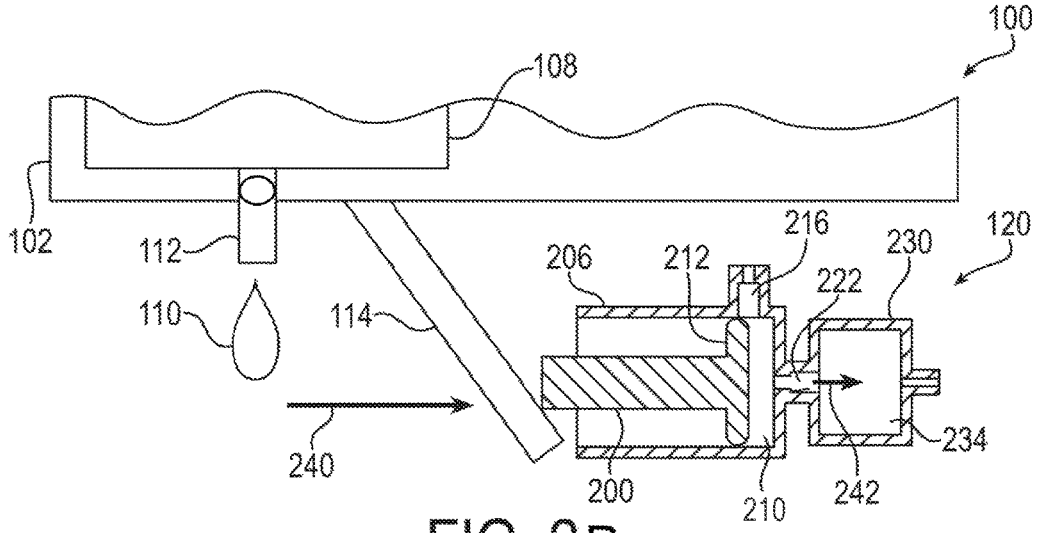
FIG. 2B is an illustration of at least some of an example dispensing system.

Turning to FIG. 2B, the actuation device 114 can be moved from a first position, as illustrated in FIG. 2A, to a second position, as illustrated in FIG. 2B a first time. In an example, a force 240 (illustrated generically/schematically with arrowheads) can be applied to the actuation device 114. The force 240 can be applied in any number of ways, such as by a user pushing/pulling on the actuation device 114. As the actuation device 114 moves from the first position to the second position, a portion of the material 110 may be dispensed from the container 108 through the outlet 112. In an example, the actuation device 114 extends between a first actuation end 280 and a second actuation end 282. The first actuation end 280 may be coupled to the housing 206 while the engagement portion 200 may be coupled to the second actuation end 282.

As the actuation device 114 is moved from the first position (FIG. 2A) to the second position (FIG. 2B) the first time, the control portion 230 does not restrain movement of either the engagement portion 200 or the actuation device 114. For example, movement of the actuation device 114 from the first position to the second position causes corresponding movement of the engagement portion 200. The sealing device 212 of the engagement portion 200 can move further into the first chamber 210 towards the second opening 222. This movement of the engagement portion 200 can cause the second valve 224 to open such that air flows from the first chamber 210, through the second opening 222, and into the second chamber 234. During this movement of the engagement portion 200, the first valve 218 remains in the closed position, such that air is generally limited from flowing through the first opening 216.

Air from the first chamber 210 can flow 242 (airflow 242 illustrated generically/schematically with arrowhead) through the second opening 222 to the second chamber 234 in response to movement of the engagement portion 200. Due to the second chamber 234 having a smaller volume than the first chamber 210, pressure within the second chamber 234 may build and increase, such that the second chamber 234 is maintained at a higher pressure with respect to the exterior of the control portion 230 and with respect to the first chamber 210.

Figure 2C:
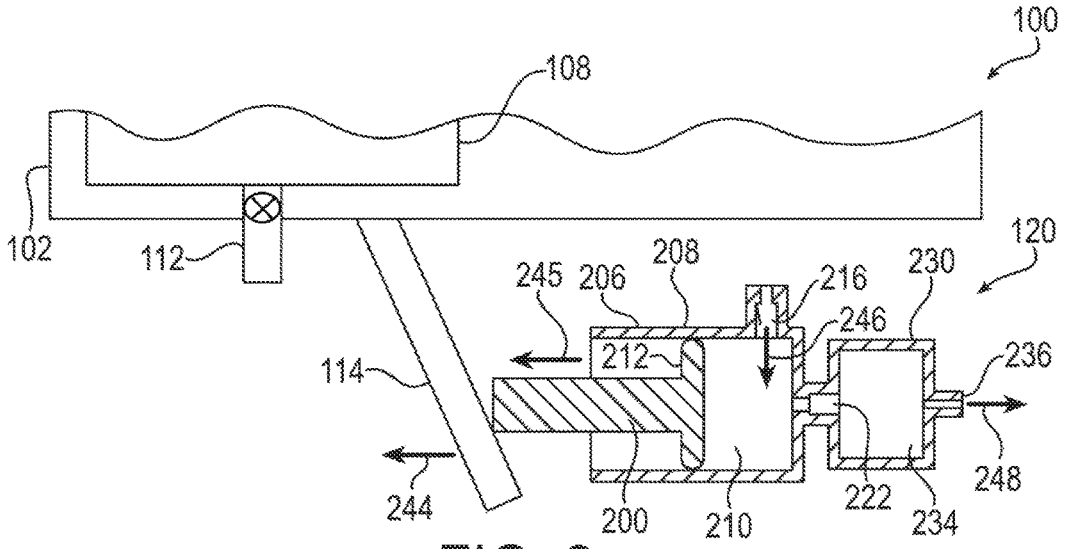
FIG. 2C is an illustration of at least some of an example dispensing system.

Turning to FIG. 2C, the actuation device 114 can be moved 244 from the second position (illustrated in FIG. 2B) back to the first position. In this example, as the actuation device 114 is moved from the second position towards the first position, the engagement portion 200 is likewise caused to move 245 in the same direction. The movement of the actuation device 114 can be caused in any number of ways. In an example, the actuation device 114 can be biased (e.g., mechanically biased, such as with springs, levers, or the like) to revert back to the first position in the absence of the force 240 (illustrated in FIG. 2B).

As the actuation device 114 moves 244 to the first position, the second valve 224 is moved from the opened position to the closed position. With the second valve 224 in the closed position, air is generally limited from flowing between the first chamber 210 and the second chamber 234. Additionally, as the actuation device 114 moves 244 to the first position, the first valve 218 may be moved from the closed position to the opened position. With the first valve 218 in the opened position, air may flow 246 from the exterior of the control portion 230 into the first chamber 210. This airflow 246 may be due to a partial vacuum (e.g., low pressure region) formed within the first chamber 210 as a result of the movement 245 of the engagement portion 200.

Due to the second chamber 234 being temporarily maintained at a higher pressure, air may exit the second chamber 234 as exiting air flow 248 through the third opening 236. The third opening 236 has a smaller cross-sectional size (e.g., diameter) than a cross-sectional size of the second opening 222, such that the exiting air flow 248 may flow through the third opening 236 at a reduced rate as compared to a rate at which the air enters the control portion 230. The exiting air flow 248 may exit the third opening 236 at least until the second chamber 234 and an exterior are at substantially the same pressure. In some examples, this pressure equalization may last a predetermined time period, such as between about 3 seconds to about 10 seconds. In other examples, however, the size of the third opening 236 can be changed, such that this predetermined time period may be longer or shorter in duration.

Figure 2D:
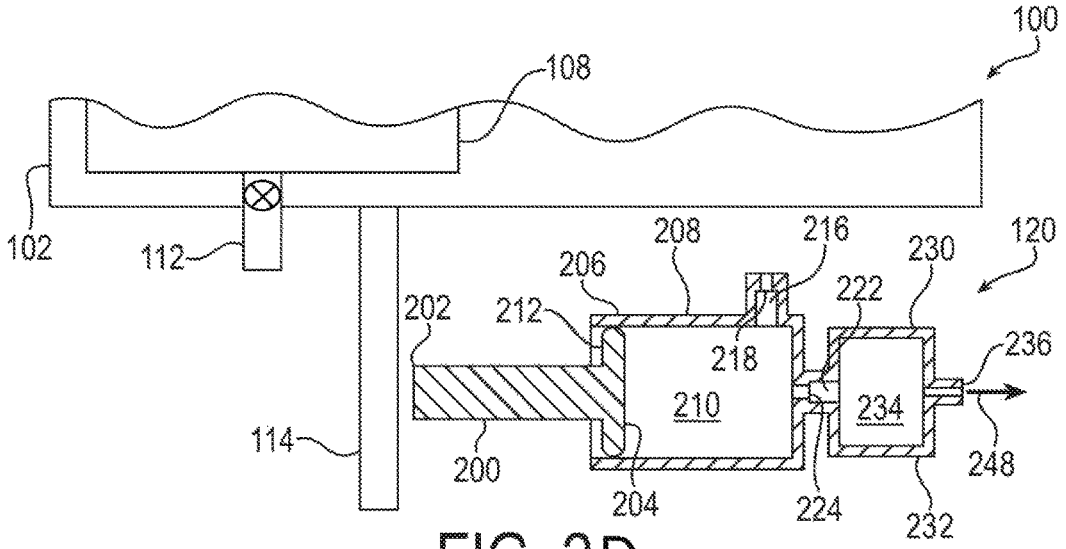
FIG. 2D is an illustration of at least some of an example dispensing system.

Turning to FIG. 2D, the actuation device 114 may fully revert to the first position, as illustrated. Within the predetermined time period, the second chamber 234 may still be at a higher pressure than the exterior, such that the exiting air flow 248 may continue to flow out of the third opening 236. In this example, the first valve 218 and the second valve 224 are in the closed position such that air is generally limited from entering and/or exiting the first chamber 210.

Figure 2E:
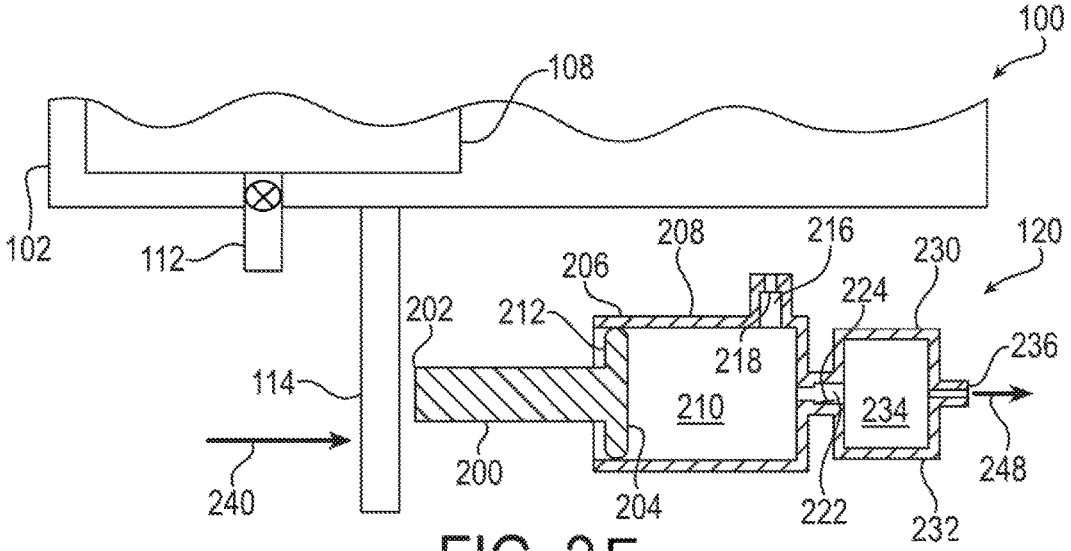
FIG. 2E is an illustration of at least some of an example dispensing system.

Turning to FIG. 2E, the actuation device 114 may be moved from the first position to the second position a second time within the predetermined time period after the first time. In this example, the force 240 is applied to the actuation device 114. Due to the second chamber 234 of the control portion 230 being temporarily maintained at a higher pressure as compared to the exterior of the control system 120, the exiting air flow 248 may continue flow out of the third opening 236. As such, the pressure within the second chamber 234 of the control portion 230 can gradually equalize with the pressure at the exterior of the control system 120.

Prior to this equalization of pressure, however, air within the first chamber 210 is generally limited from flowing through the second opening 222 and into the second chamber 234. That is, since the second chamber 234 of the control portion 230 is temporarily maintained at the higher pressure, further air flow into the second chamber 234 is limited. Accordingly, the control portion 230 can restrain movement of the engagement portion 200 and the actuation device 114. For example, as the force 240 is applied to the actuation device 114, movement of the actuation device 114 and the engagement portion 200 towards the control portion 230 are restrained/limited, since air within the first chamber 210 is limited from flowing into the pressurized second chamber 234 of the control portion 230.

As such, within the predetermined time period (e.g., time for pressure within the second chamber 234 to equalize), such as about 3 seconds to about 10 seconds, movement of the actuation device 114 and the engagement portion 200 may be restrained. Since the actuation device 114 is restrained and limited from moving from the first position to the second position, dispensing of the material 110 from the container 108 is likewise limited until the predetermined time period has passed. The control system 120 can therefore reduce the likelihood of excessive dispensing of the material 110 and, thus, reduce the risk of over ingestion of the material 110 by a user.

Figure 3A:
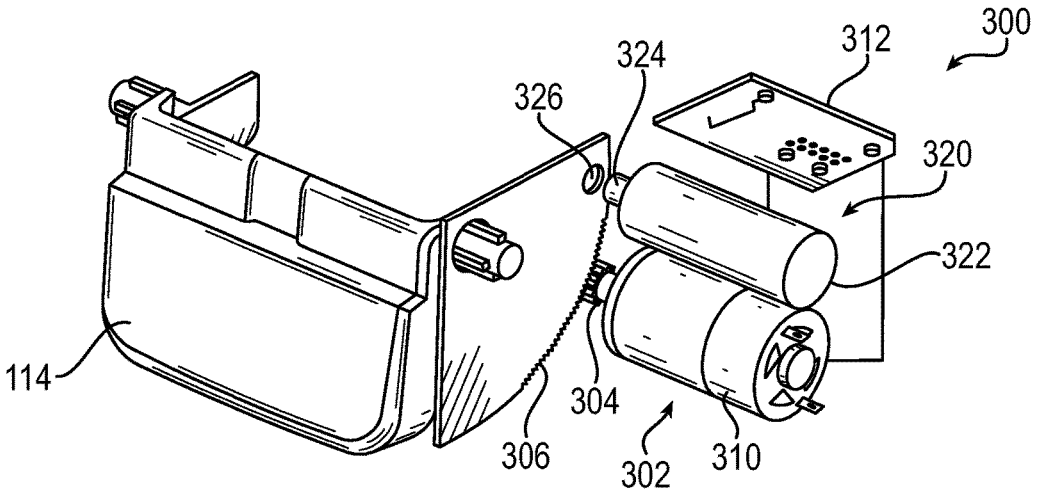
FIG. 3A is an illustration of at least some of an example dispensing system.

Turning to FIG. 3A, a second example control system 300 is illustrated. The control system 300 can be incorporated as part of the dispensing system 100, such as by engaging the actuation device 114, for example. In an example, the control system 300 can be positioned in a generally similar location as the control system 120 illustrated in FIG. 1.

The control system 300 is movably supported with respect to the actuation device 114. In an example, the control system 300 comprises an engagement portion 302 that is in movable engagement with the actuation device 114. The engagement portion includes a first gear 304. The first gear 304 comprises a plurality of teeth, such that engagement of the teeth can cause the first gear 304 to rotate. In an example, the actuation device 114 includes a surface feature 306 extending along an edge of the actuation device 114. In the illustrated example, the surface feature 306 comprises a plurality of teeth that are sized/shaped to engage/mesh with the teeth of the first gear 304. As such, movement of the actuation device 114 can cause corresponding rotational movement of the first gear 304 through engagement of the surface feature 306 and the teeth of the first gear 304.

The surface feature 306 is not limited to teeth, however, and in other examples, may include any number of structures/constructions that can engage the first gear 304 and cause movement/rotation of the first gear 304. For example, the surface feature 306 may include an adhesive, a relatively high friction surface (e.g., rubber, elastomer, etc.), mechanical structures (e.g., belts, pulleys, etc.), or the like to facilitate engagement with the first gear 304. In such an example, the first gear 304 may or may not include the teeth, provided that the surface feature 306 can cause movement/rotation of the first gear 304.

The engagement portion 302 comprises an electric generator 310. The electric generator 310 is coupled to the first gear 304, such as by a shaft that extends from the first gear 304 and is rotatable by the first gear 304. The electric generator 310 can convert movement of the actuation device 114 to electrical energy. In general, the electric generator 310 can convert mechanical energy (e.g., rotation of the first gear 304) into electrical energy. The electric generator 310 comprises any number of structures that are capable of producing electrical energy from mechanical energy, including, but not limited to, induction generators, alternators/dynamos, electrostatic generators, etc.

The electric generator 310 may be electrically connected to a circuit board 312. In general, the electrical energy produced by the electric generator 310 may be transferred to the circuit board 312. The circuit board 312 may be included as part of the control system 300, such as by being stored within a housing, case or the like. According to some examples, a visual device can be provided in association with the circuit board 312. For example, the visual device may include a light, light emitting diode (LED), or other similar component that is visible to a user. The visual device can selectively light up (e.g., from electrical energy from the electric generator 310) to notify the user when the actuation device 114 is temporarily locked.

The control system 300 includes a control portion 320. The control portion 320 is coupled to at least one of the engagement portion 302 or the actuation device 114. In an example, the control portion 320 includes a solenoid 322 that is electrically connected to the electric generator 310. In such an example, the solenoid 322 is electrically connected to the circuit board 312, such that the solenoid 322 can receive the electrical energy from the electric generator 310. In general, the solenoid 322 is an electromechanical device that can move and/or cause movement between a plurality of positions. For example, the solenoid 322 may be moved by the electrical energy (e.g., electric current) from the electric generator 310 between an unlocked position and a locked position.

The solenoid 322 comprises a locking structure 324 that is movable between the locked position and the unlocked position. In an example, the locking structure 324 of the solenoid 322 is positioned in proximity to a locking opening 326 defined within the actuation device 114. The locking opening 326 defines a recess, channel, gap, space, indentation, depression, etc., that extends partially or completely through a wall of the actuation device 114. While one locking opening 326 is illustrated in this example, any number of locking openings 326 (e.g., one or more) may be provided. The locking opening(s) 326 may be sized/shaped to receive/accommodate the locking structure 324. For example, the locking structure 324 may have a generally circular shape while the locking opening 326 may also have a generally circular shape that is slightly larger in size than the locking structure 324. As such, when the locking structure 324 is received within the locking opening 326, the actuation device 114 is generally non-movable and/or fixed in position relative to the control portion 320.

In the illustrated example, the locking opening 326 is positioned towards an upper end of the actuation device 114. As such, in this example, the locking opening 326 can receive/accommodate the locking structure 324 when the actuation device 114 is in the first position. The locking opening 326 is not limited to such a position, however. In other examples, the locking opening 326 may be positioned towards a lower end of the actuation device 114, such that the locking opening 326 can receive/accommodate the locking structure 324 when the actuation device 114 is in the second position. Similarly, in other examples, the locking opening 326 could be positioned at nearly any location within the actuation device 114.

In the unlocked position, as illustrated in FIG. 3A, the locking structure 324 may not be received within the locking opening 326. Indeed, the locking structure 324 may be spaced apart from and/or separated from the locking opening 326. As such, the actuation device 114 may freely move without the locking structure 324 restraining and/or interfering with the movement of the actuation device 114. In the locked position, as illustrated in FIG. 3E, the locking structure 324 is moved (e.g., by the solenoid 322) so as to extend through the locking opening 326. As such, with the locking structure 324 extending through the locking opening 326, the actuation device 114 is generally restrained from movement by the control portion 320.

Figure 3B:
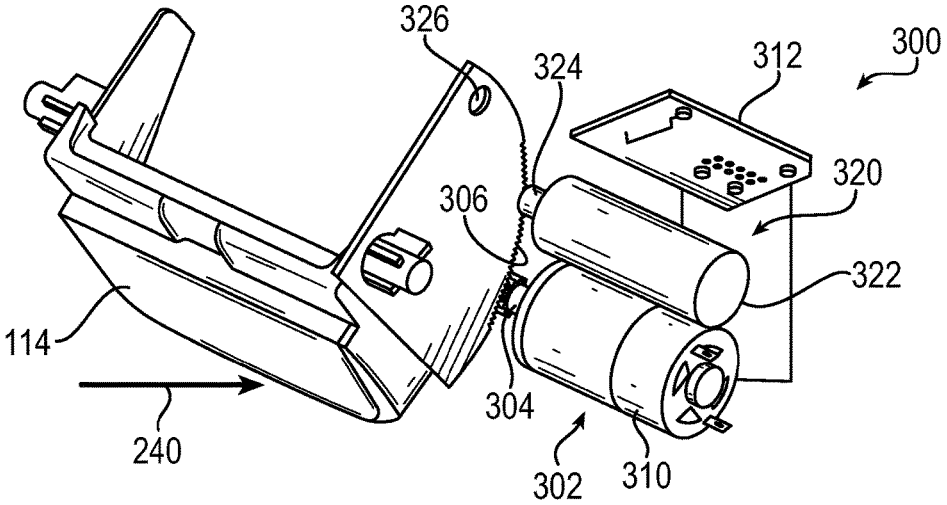
FIG. 3B is an illustration of at least some of an example dispensing system.

Turning to FIG. 3B, the actuation device 114 can be moved from the first position, as illustrated in FIG. 3A, to the second position, as illustrated in FIG. 3B, a first time. In an example, the force 240 can be applied to the actuation device 114. The force 240 can be applied in any number of ways, such as by a user pushing/pulling on the actuation device 114. As the actuation device 114 moves from the first position to the second position, a portion of the material 110 (illustrated in FIG. 1) may be dispensed.

As the actuation device 114 is moved from the first position (FIG. 3A) to the second position (FIG. 3B) the first time, the control portion 320 does not restrain movement of either the engagement portion 302 or the actuation device 114. For example, movement of the actuation device 114 from the first position to the second position causes corresponding movement of the first gear 304. As the actuation device 114 moves, the surface feature 306 engages the first gear 304 and causes rotational movement of the first gear 304. The electric generator 310 can convert this movement of the actuation device 114 to electrical energy.

In an example, the electrical energy generated by the electric generator 310 may be stored and/or dissipated by the electric generator 310 as long as the electrical energy is below a predetermined threshold. In another example, the electrical energy generated by the electric generator 310 may be transferred to the circuit board 312, whereupon the electrical energy may be stored and/or dissipated as long as the electrical energy is below the predetermined threshold. In either of these examples, the amount of electrical energy generated by the electric generator 310 in response to movement of the actuation device 114 from the first position to the second position the first time is not sufficient to cause the solenoid 322 to move from the unlocked position (as illustrated) to the locked position.

Figure 3C:
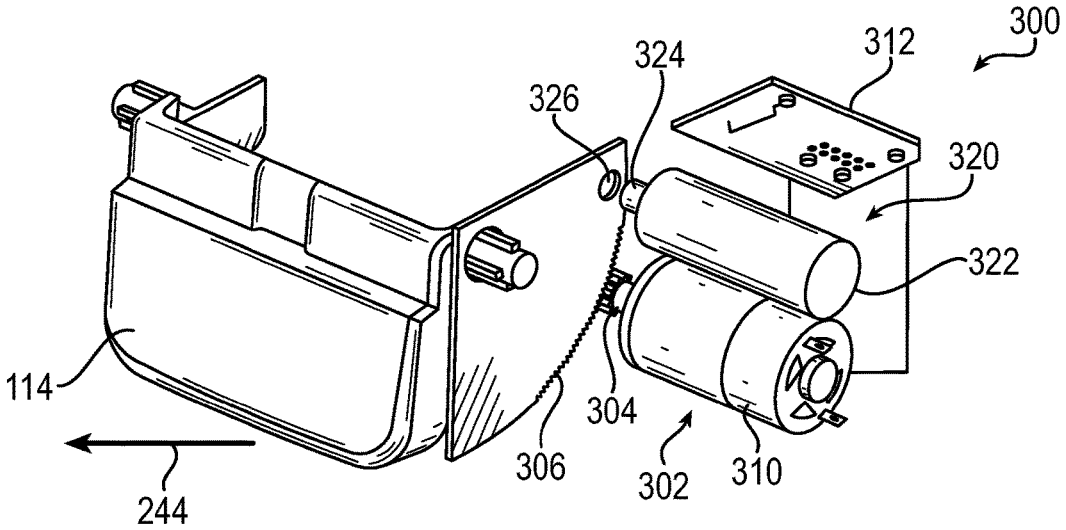
FIG. 3C is an illustration of at least some of an example dispensing system.

Turning to FIG. 3C, the actuation device 114 can be moved 244 from the second position (illustrated in FIG. 3B) back to the first position. As the actuation device 114 is moved from the second position towards the first position, the first gear 304 may again be caused to rotate by the surface feature 306 in a rotational direction that is opposite the rotational direction illustrated in FIG. 3B. In this example, rotation of the first gear 304 in this opposite direction may not cause the electric generator 310 to generate electrical energy. Rather, in some examples, the electric generator 310 may generate electrical energy when the first gear 304 is rotated in one direction, but may not generate electrical energy when the first gear 304 is rotated in an opposite direction.

As the actuation device 114 moves 244 to the first position, the electrical energy generated by the electric generator 310 may continue to be dissipated. In some examples, the electrical energy generated by the electric generator 310 may be completely dissipated over a predetermined time period, such as between about 3 seconds to about 10 seconds. In other examples, this predetermined time period may be longer or shorter in duration.

Figure 3D:
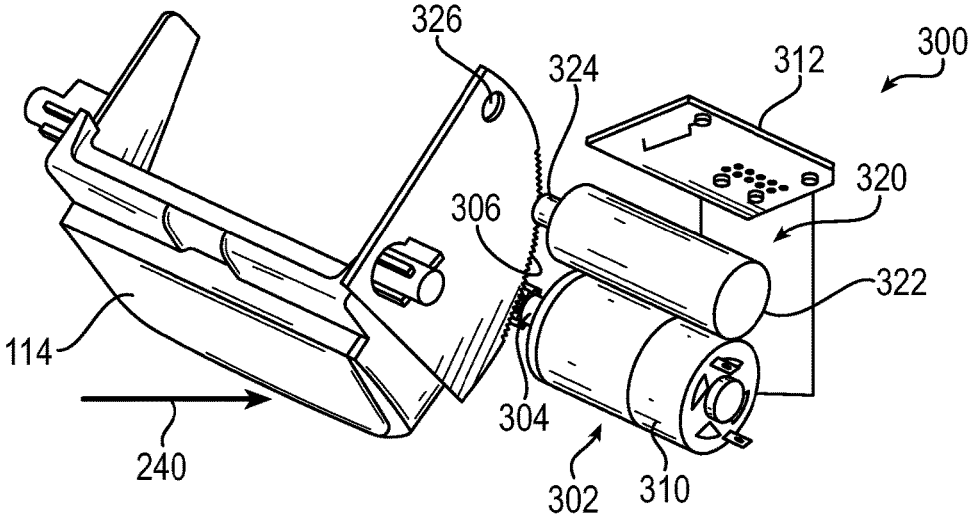
FIG. 3D is an illustration of at least some of an example dispensing system.
Figure 3E:
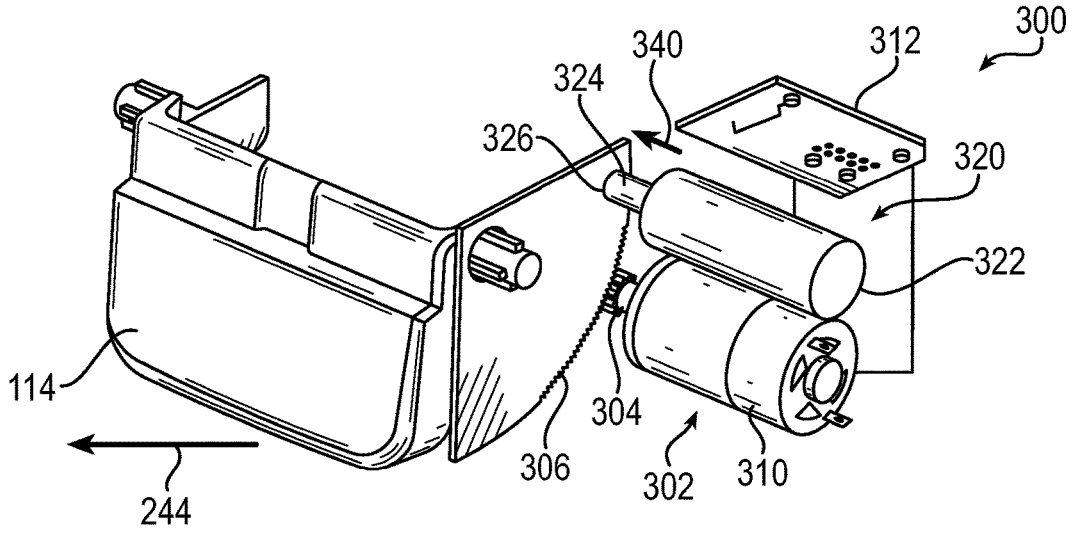
FIG. 3E is an illustration of at least some of an example dispensing system.

Turning to FIG. 3D, the actuation device 114 may be moved from the first position (illustrated in FIG. 3C) to the second position (illustrated in FIG. 3D) a second time within the predetermined time period after the first time. In this example, the force 240 is applied to the actuation device 114. As the actuation device 114 is moved from the first position to the second position the second time within the predetermined time period, the surface feature 306 can again engage the first gear 304 and cause rotational movement of the first gear 304. The electric generator 310 can convert this movement of the actuation device 114 to electrical energy.

In this example, the movement of the actuation device 114 from the first position to the second position for the second time (illustrated in FIG. 3D) takes place within the predetermined time period after the first time. As such, the electrical energy that was previously generated by the electric generator 310 during the first time is not completely dissipated. When the actuation device 114 is moved the second time, electrical energy is again generated by the electric generator 310, such that this newly generated electrical energy is combined with the previously generated electrical energy that has not completely dissipated. This combined electrical energy may be above a predetermined threshold and may be transferred to the control portion 320.

Turning to FIG. 3E, the actuation device 114 may be moved from the second position (illustrated in FIG. 3D) to the first position (illustrated in FIG. 3E). In this example, due to the actuation device 114 being moved between the first position and the second position the second time within the predetermined time period after the first time, the control portion 320 can restrain movement of at least one of the engagement portion 302 or the actuation device 114. For example, the electrical energy is above the predetermined threshold. As such, this electrical energy from the electric generator 310 can cause the locking structure 324 of the solenoid 322 to move 340 (illustrated generically/schematically with arrowhead) from the unlocked position to the locked position relative to the locking opening 326.

In the locked position, the locking structure 324 of the solenoid 322 can extend through the locking opening 326 of the actuation device 114 to restrain movement of the actuation device 114. In such an example, the actuation device 114 is restrained from moving from the first position to the second position while the locking structure 324 extends through the locking opening 326. The locking structure 324 can remain in the locked position during the predetermined time period, such as about 3 seconds to about 10 seconds.

Within the predetermined time period, movement of the actuation device 114 is restrained. Since the actuation device 114 is restrained and limited from moving from the first position to the second position, dispensing of the material 110 from the container 108 is likewise limited until the predetermined time period has passed. The control system 300 can therefore reduce the likelihood of excessive dispensing of the material 110 and, thus, reduce the risk of over ingestion of the material 110 by the user. The predetermined time period may end, for example, when the electrical energy from the electric generator 310 has been fully used to hold the locking structure 324 in the locked position. At such a time, after the predetermined time period ends, the locking structure 324 may move from the locked position to the unlocked position, wherein the locking structure 324 no longer extends through the locking opening 326.

Figure 4A:
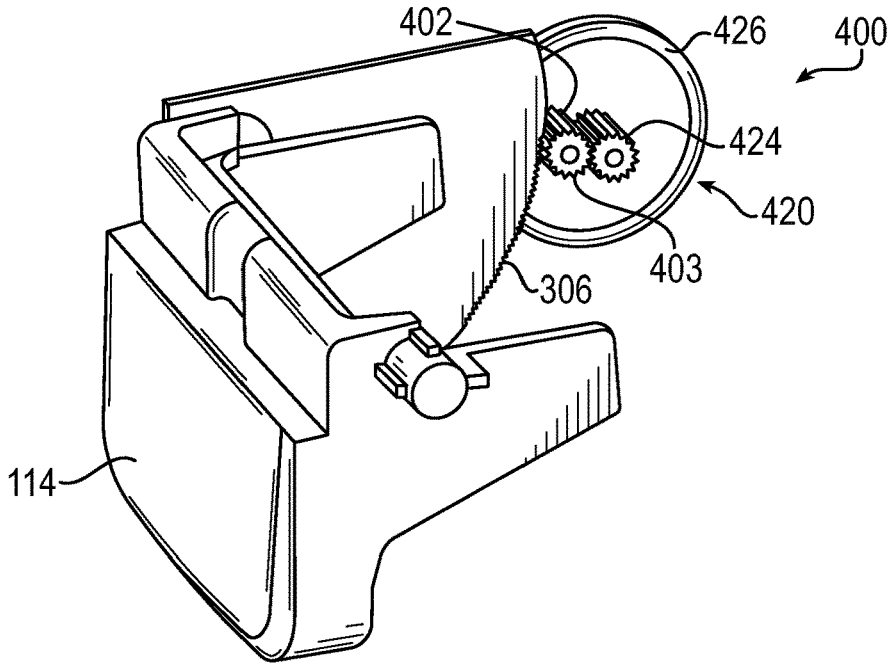
FIG. 4A is an illustration of at least some of an example dispensing system.

Turning to FIG. 4A, a third example control system 400 is illustrated. The control system 400 can be incorporated as part of the dispensing system 100, such as by engaging the actuation device 114, for example. In an example, the control system 400 can be positioned in a generally similar location as the control system 120 illustrated in FIG. 1.

The control system 400 is movably supported with respect to the actuation device 114. In an example, the control system 400 comprises an engagement portion 402 that is in movable engagement with the actuation device 114. In some examples, the engagement portion 402 comprises a first gear, 403 though any number of structures are envisioned. In the illustrated example, the engagement portion 402 comprises a plurality of teeth, such that engagement of the teeth can cause the engagement portion 402 to rotate. In this example, the actuation device 114 may include the surface feature 306 extending along the edge of the actuation device 114. The surface feature 306 can engage/mesh with the teeth of the engagement portion 402. As such, movement of the actuation device 114 can cause corresponding rotational movement of the engagement portion 402.

The control system 400 includes a control portion 420. The control portion 420 is coupled to at least one of the engagement portion 402 or the actuation device 114. In an example, the control portion 420 includes a second gear 424. The second gear 424 may include a plurality of teeth, such that the teeth of the second gear 424 can engage/mesh with the teeth of the first gear 403. In such an example, as the first gear 403 rotates, the second gear 424 can also rotate.

The control portion 420 can include a flywheel 426. The flywheel 426 may be attached/coupled to the second gear 424, such that rotation of the second gear 424 can cause corresponding rotation of the flywheel 426. In the illustrated example, the second gear 424 and the flywheel 426 may be directly attached to each other, such as with adhesives, mechanical fasteners, a snap-fit/locking construction, and/or by being one-piece formed. In other examples, however, the second gear 424 and the flywheel 426 may be indirectly attached/coupled, such as by a shaft extending from the second gear 424 to the flywheel 426. In general, the flywheel 426 can resist changes in rotational speed of the second gear 424. The control portion 420 is not limited to including the flywheel 426, as illustrated, and, in other examples, may include other structures/devices that can resist changes in rotational speed of the second gear 424, such as by using one or more gears, dampers, or the like.

Figure 4B:
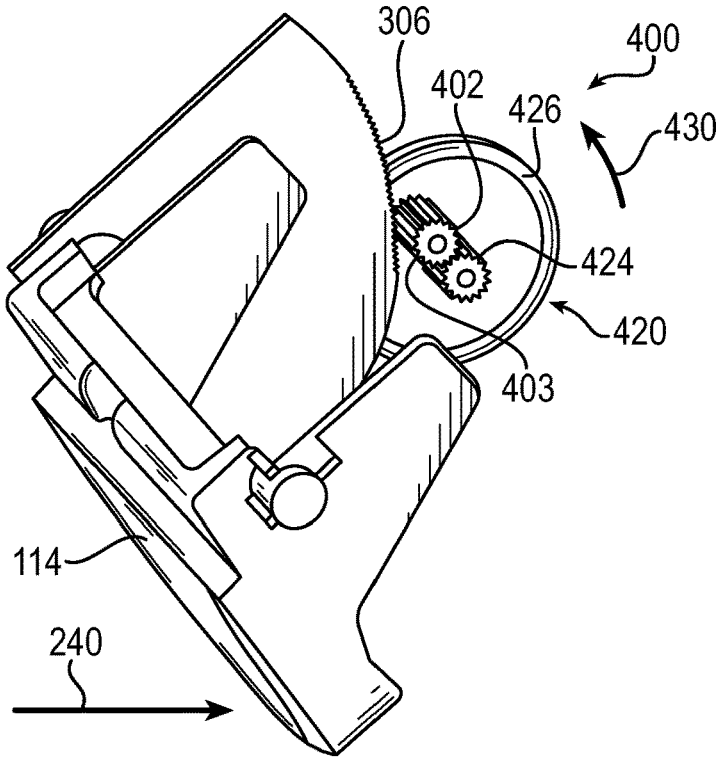
FIG. 4B is an illustration of at least some of an example dispensing system.

Turning to FIG. 4B, the actuation device 114 can be moved from the first position, as illustrated in FIG. 4A, to the second position, as illustrated in FIG. 4B, a first time. In an example, the force 240 can be applied to the actuation device 114. The force 240 can be applied in any number of ways, such as by a user pushing/pulling on the actuation device 114. As the actuation device 114 moves from the first position to the second position, a portion of the material 110 (illustrated in FIG. 1) may be dispensed.

As the actuation device 114 is moved from the first position (FIG. 4A) to the second position (FIG. 4B) the first time, the control portion 420 does not restrain movement of either the engagement portion 402 or the actuation device 114. For example, movement of the actuation device 114 from the first position to the second position causes the flywheel 426 to rotate in a first rotational direction 430. In this example, the flywheel 426 may not restrain/restrict movement when rotating in the first rotational direction 430. As such, the actuation device 114 can be freely moved from the first position to the second position the first time.

Figure 4C:
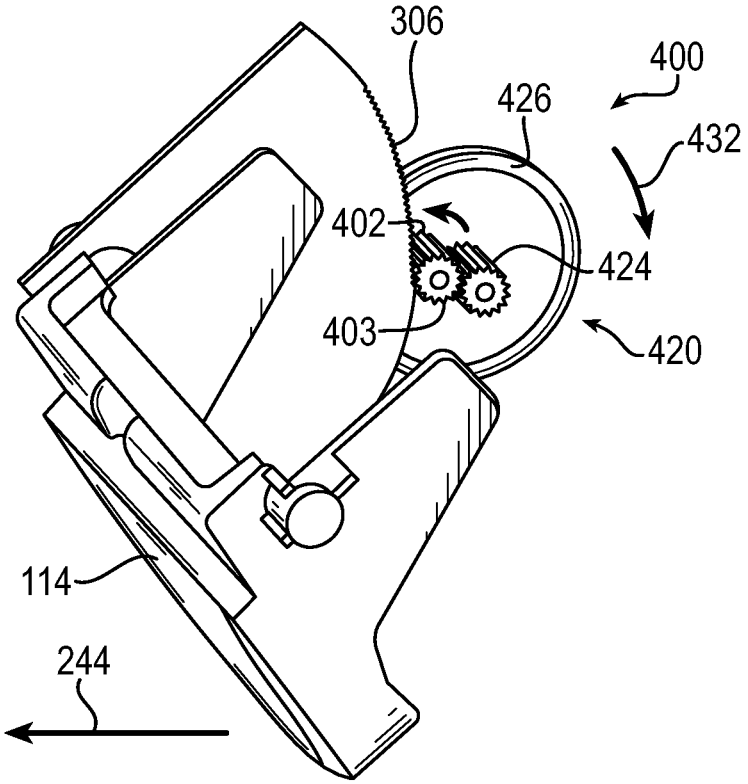
FIG. 4C is an illustration of at least some of an example dispensing system.

Turning to FIG. 4C, the actuation device 114 can be moved 244 from the second position (illustrated in FIG. 4B) back to the first position. In this example, as the actuation device 114 moves to the first position, the flywheel 426 can rotate in a second rotational direction 432 that is opposite the first rotational direction 430. In the illustrated example, the flywheel 426 of the control portion 420 can restrain movement of the actuation device 114 as the actuation device 114 is moved from the second position to the first position and the flywheel 426 rotates in the second rotational direction 432. For example, the flywheel 426 can have a reduced/slower rotational speed when rotating in the second rotational direction 432.

This reduced/slower rotational speed can cause the actuation device 114 to take a longer time to move from the second position to the first position. In a possible example, the reduced rotational speed of the flywheel 426 in the second rotational direction 432 can cause the actuation device 114 to last a predetermined time period in moving from the second position to the first position. In some examples, this predetermined time period is between about 3 seconds to about 10 seconds. In other examples, this predetermined time period may be longer or shorter in duration.

During the predetermined time period, movement of the actuation device 114 is restrained. Since the actuation device 114 is restrained, dispensing of the material 110 from the container 108 is likewise limited until the predetermined time period has passed. The control system 400 can therefore reduce the likelihood of excessive dispensing of the material 110 and, thus, reduce the risk of over ingestion of the material 110 by the user.

Figure 5:
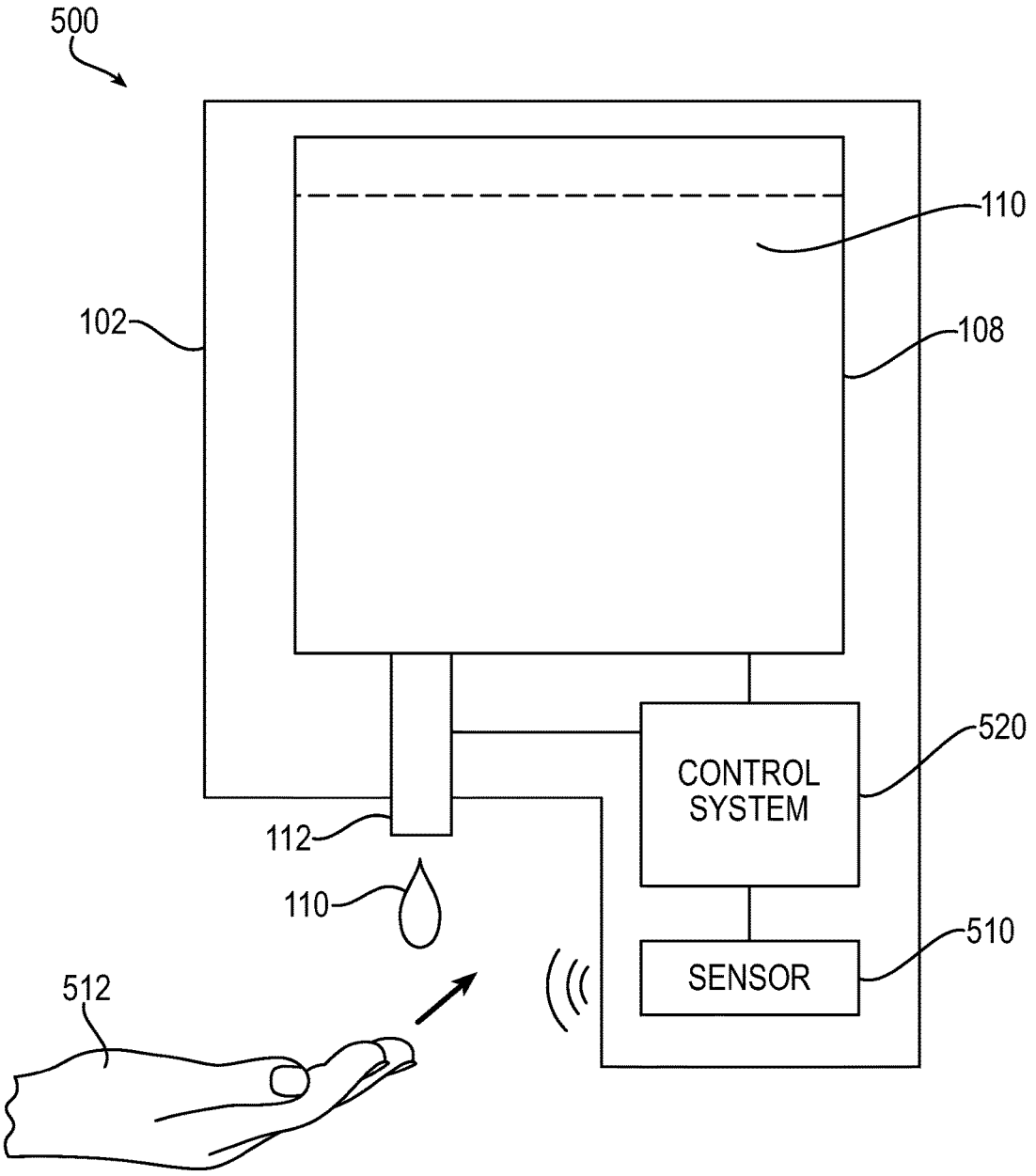
FIG. 5 is an illustration of at least some of an example dispensing system.

Turning to FIG. 5, a second example dispensing system 500 is illustrated. The Dispensing system 500 is similar in some respects to the dispensing system 100 of FIG. 1. For example, the dispensing system 500 may include the housing 102, the container 108, the material 110, etc.

The dispensing system 500 can include a sensor 510 positioned within the housing 102 and coupled to the container 108. In an example, the sensor 510 can detect a presence of a user 512 (illustrated generically/schematically with a user's hand) in proximity to the dispensing system 500. In some examples, the sensor 510 comprises a proximity sensor that can communicate with the outlet 112 of the container 108 to cause the material 110 to be dispensed from the container 108 to the user 512. The sensor 510 comprises any number of sensors, including active sensors, passive sensors, infrared sensors, parallel sensors, triangulated sensors, position sensitive sensors, time of flight distance sensors, radio frequency signal strength, capacitive sensors, inductive sensors, microwave sensors, optical sensors, or the like. In some examples, the sensor 510 comprises sonar, ultrasonic, or laser sensors. Indeed, the sensor 510 comprises nearly any type of sensor that can detect the presence of the user 512 without physical contact.

The dispensing system 500 can include a control system 520. In some examples, the control system 520 may include a logic controller (e.g., microcontroller, etc.), or the like. The control system 520 may be coupled (e.g., electrically connected) to the outlet 112 of the container 108 and to the sensor 510. In an example, the control system 520 can control the dispensing of the material 110 from the container 108.

According to some examples, the sensor 510 may detect the presence of the user 512 in proximity to the dispensing system 500 a first time. In response, the control system 520 may not inhibit a dispense event, such that at least some of the material 110 is dispensed from the container 108, as illustrated. Indeed, the sensor 510 can communicate to the control system 520 the presence of the user 512 such that the control system 520 triggers at least some of the material 110 to be dispensed.

In some examples, the sensor 510 may detect the presence of the user 512 in proximity to the dispensing system 500 a second time within a predetermined time period after the first time. The user 512 may include both the same user 512 as the first time and/or a different user. In some examples, this predetermined time period is between about 3 seconds to about 10 seconds. In another example, this predetermined time period is less than about 3 seconds.

As the sensor 510 detects the presence of the user 512 in proximity to the dispensing system 500 the second time within the predetermined time period, the control system 520 can inhibit a subsequent dispense event such that additional material 110 is not dispensed from the container 108. According to some examples, an application-specific integrated circuit (ASIC) may be provided as part of the control system 520. In such an example, the ASIC can be programmed to limit the subsequent dispense event from occurring within the predetermined time period after the first dispense event. In another example, programming within the control system 520 can be adjusted to limit the subsequent dispense event from occurring until after the predetermined time period.

By limiting multiple dispense events from occurring within the predetermined time period, the control system 120, 300, 400, 520 can reduce the likelihood of excessive dispensing of the material 110 to the user(s) 512. This limit on dispensing may be effective in environments in which ingestion of the material 110 is sought to be minimized For example, environments in which user(s) 512 may attempt to ingest the material 110 include prisons/jails, detention centers, mental health facilities, rehabilitation facilities, etc. It may be beneficial to limit the ability of the user 512 from receiving a relatively large quantity of the material 110 within a short period of time. As such, the control system 120, 300, 400, 520 can limit a subsequent dispense event from occurring after a first dispense event within the predetermined time period. To further limit the user(s) 512 from improperly accessing the material 110, the housing 102 is relatively rigid/secure, such as by comprising a metal material, for example.

Although the subject matter has been described in language specific to structural features or methodological acts, it is to be understood that the subject matter defined in the appended claims is not necessarily limited to the specific features or acts described above. Rather, the specific features and acts described above are disclosed as example forms of implementing at least some of the claims.

Various operations of embodiments are provided herein. The order in which some or all of the operations described should not be construed to imply that these operations are necessarily order dependent. Alternative ordering will be appreciated having the benefit of this description. Further, it will be understood that not all operations are necessarily present in each embodiment provided herein. Also, it will be understood that not all operations are necessary in some embodiments.

Many modifications may be made to the instant disclosure without departing from the scope or spirit of the claimed subject matter. Unless specified otherwise, "first," "second," or the like are not intended to imply a temporal aspect, a spatial aspect, an ordering, etc. Rather, such terms are merely used as identifiers, names, etc. for features, elements, items, etc. For example, a first component and a second component generally correspond to component A and component B or two different or two identical components or the same component.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application are generally to be construed to mean "one or more" unless specified otherwise or clear from context to be directed to a singular form. Also, at least one of A and B or the like generally means A or B or both A and B. Furthermore, to the extent that "includes", "having", "has", "with", or variants thereof are used in either the detailed description or the claims, such terms are intended to be inclusive in a manner similar to "comprising".

Also, although the disclosure has been illustrated and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A dispensing system comprising:

a container within which a material is contained and from which the material is dispensed;

an actuation device movably supported with respect to the container, the actuation device movable between a first position, in which the material is not dispensed from the container, and a second position, in which at least some of the material is dispensed from the container; and a control system movably supported with respect to the actuation device, the control system comprising:

an engagement portion in movable engagement with the actuation device;

a control portion operably coupled to at least one of the engagement portion or the actuation device, wherein as the actuation device is moved from the first position to the second position a first time, the control portion is not configured to restrain a first movement of either the engagement portion or the actuation device, wherein as the actuation device is moved between the first position and the second position a second time within a predetermined time period after the first time, the control portion is configured to restrain a second movement of at least one of the engagement portion or the actuation device, wherein the engagement portion is positioned within a first chamber, the first chamber defined by sidewalls that also define a first opening and a second opening; and a first valve positioned within the first opening, the first valve movable between an opened position, in which air flows through the first opening and into the first chamber, and a closed position, in which the air does not flow through the first opening.

2. The dispensing system of claim 1, comprising a second valve positioned within the second opening, the second valve movable between an opened position, in which chamber air flows through the second opening and out of the first chamber, and a closed position, in which the chamber air does not flow through the second opening.

3. The dispensing system of claim 2, wherein the control portion is in fluid communication with the second opening, the control portion comprising control portion sidewalls that define a second chamber that is configured to receive the chamber air from the first chamber through the second opening.

4. The dispensing system of claim 3, wherein the control portion sidewalls define a third opening through which second chamber air flows out of the second chamber.

5. The dispensing system of claim 1, comprising a housing within which the container is housed, the housing comprising a metal material.

6. A dispensing system comprising:

a container within which a material is contained and from which the material is dispensed;

an actuation device movably supported with respect to the container, the actuation device movable between a first position, in which the material is not dispensed from the container, and a second position, in which at least some of the material is dispensed from the container; and a control system movably supported with respect to the actuation device, the control system comprising:

an engagement portion in movable engagement with the actuation device, the engagement portion movable as the actuation device moves between the first position and the second position; and a control portion operably coupled to at least one of the engagement portion or the actuation device, wherein the engagement portion is positioned within a chamber defined by the control portion and as the actuation device is moved from the first position to the second position a first time, the control portion is not configured to restrain a first movement of either the engagement portion or the actuation device, wherein as the actuation device is moved from the first position to the second position a second time within a predetermined time period after the first time, the control portion is configured to restrain a second movement of the actuation device.

7. The dispensing system of claim 6, comprising a housing within which the container is housed.

8. The dispensing system of claim 7, wherein the housing comprises a metal material.

9. The dispensing system of claim 7, wherein the control system is not located within the housing.

10. The dispensing system of claim 6, wherein the material comprises a cleaning material.

11. A dispensing system comprising:

a container within which a material is contained and from which the material is dispensed;

an actuation device movably supported with respect to the container, the actuation device including a surface feature, the actuation device movable between a first position, in which the material is not dispensed from the container, and a second position, in which at least some of the material is dispensed from the container; and a control system movably supported with respect to the actuation device, the control system comprising:

an engagement portion coupled to the actuation device, the engagement portion movable in tandem with the actuation device as the actuation device moves from the first position to the second position and from the second position to the first position; and a control portion operably coupled to at least one of the engagement portion or the actuation device, wherein as the actuation device is moved from the first position to the second position a first time, the control portion is not configured to restrain a first movement of either the engagement portion or the actuation device, wherein as the actuation device is moved from the first position to the second position a second time within a predetermined time period after the first time, the control portion is configured to restrain a second movement of at least one of the engagement portion or the actuation device, wherein the surface feature cooperates with the engagement portion such that motion of the actuation device causes movement of the engagement portion and movement of the engagement portion causes movement of the actuation device.

12. The dispensing system of claim 11, comprising a housing within which the container is housed.

13. The dispensing system of claim 12, wherein the housing comprises a metal material.

14. The dispensing system of claim 13, wherein the control system is not located within the housing.

15. The dispensing system of claim 12, wherein the actuation device extends between a first actuation end and a second actuation end, the first actuation end coupled to the housing.

16. The dispensing system of claim 15, wherein the engagement portion is coupled to the second actuation end.

17. The dispensing system of claim 11, wherein the material comprises a cleaning material.

18. The dispensing system of claim 11, wherein the engagement portion extends between a first end and a second end, the first end coupled to the actuation device.

19. The dispensing system of claim 18, wherein the second end of the engagement portion is coupled to the control portion.

20. The dispensing system of claim 19, wherein the engagement portion has a non-constant cross-sectional size between the first end and the second end.

* * * * *